United States Patent [19]

Van Sickle

[11] 4,217,733

[45] Aug. 19, 1980

[54] METHOD OF AND APPARATUS FOR EFFECTING COMBINED SURFACE FINISHING OPERATIONS FOR A TAPERED ROLLER BEARING CUP

[75] Inventor: Robert J. Van Sickle, Richmond, Va.

[73] Assignee: Rail Bearing Service, Richmond, Va.

[21] Appl. No.: 20,732

[22] Filed: Mar. 15, 1979

[51] Int. Cl.[3] ..... B24B 5/18

[52] U.S. Cl. ..... 51/103 R; 51/291; 15/21 C; 15/21 D

[58] Field of Search ..... 15/21 C, 21 D; 51/103 R, 103 WH, 290, 291, 3, 215 UE, 88, 89

[56] References Cited

U.S. PATENT DOCUMENTS

| | | | |
|---|---|---|---|
| 1,842,375 | 1/1932 | Einstein | 51/103 R X |
| 1,882,814 | 10/1932 | Haas | 51/103 R X |
| 1,974,696 | 9/1934 | Swanson | 51/103 WH X |
| 2,004,649 | 6/1935 | Booth et al. | 51/103 R X |
| 2,078,416 | 4/1937 | Sauer | 51/103 R X |
| 2,807,916 | 10/1957 | Squire et al. | 51/291 X |
| 3,158,970 | 12/1964 | Lockwood | 51/103 WH X |
| 3,457,576 | 7/1969 | Yarrow | 51/21 C |
| 3,657,843 | 4/1972 | Uhtenwoldt et al. | 51/103 R |

FOREIGN PATENT DOCUMENTS 2061243 12/1971 Fed. Rep. of Germany ..... 51/3

*Primary Examiner*—Gary L. Smith
*Assistant Examiner*—Robert P. Olszewski
*Attorney, Agent, or Firm*—Richard P. Matthews

[57] ABSTRACT

A method of and apparatus for effecting combined surface finishing operations for a cup for tapered roller bearings. The apparatus will accept cups of random sizes, will automatically load them onto an indexing mechanism, index the cups through necessary work stations, and discharge the surface-finished cups. At the surface finishing station, a drive roller frictionally engages the cup and rotates it while a plurality of brushes are brought into engagement with the surfaces to be finished. The brushes are rotated in a direction which results in a force component which tends to hold the cup within the open pockets of the indexing mechanism. The brushes are also wear compensating so that the apparatus will operate without an attendant and without requiring a preliminary set-up or changing of parts for different sizes of bearing cups.

14 Claims, 6 Drawing Figures

METHOD OF AND APPARATUS FOR EFFECTING COMBINED SURFACE FINISHING OPERATIONS FOR A TAPERED ROLLER BEARING CUP

This invention relates to a method of and apparatus for effecting combined surface finishing operations for cups for tapered roller bearings and, more particularly, of such a method and apparatus which eliminates substantially all of the manual cup handling and manual surface finishing as now performed in the re-manufacture of tapered roller bearing components.

Tapered roller bearings are provided with cup members within which are received a pair of cone assemblies and a spacer element therebetween. The cups themselves are heavy, typically weighing from 40 to 60 pounds and a substantial market exists for re-manufacturing tapered roller bearings after periods of use. The cups themselves have a cylindrical outer diameter and an internal raceway. The latter includes opposed inboard and outboard cylindrical seal counterbores and a pair of conical inboard and outboard raceway surfaces which slope toward a centrally located cylindrical raceway portion.

Heretofore, it has been the custom to surface finish the external and internal surfaces of the cup by hand. This has been not only time consuming but also very expensive.

In accordance with the present invention the foregoing expensive hand labor is eliminated. In fact, the apparatus of the present invention functions completely unattended even though it will accept and process bearing cups of random sizes and in random order.

Many of the features of the apparatus of the present invention will become apparent upon considering the following principal method steps employed in practicing this invention:

a. roller bearing cups are fed by gravity to an indexing means;

b. the cups are indexed sequentially from an infeed position to an outfeed position;

c. the cup to be surface finished is engaged with a rotatable drive roller and is rotated thereby;

d. the cylindrical outer surface of the cup is contacted with a first brush which traverses the length of the cup while the cup is being rotated;

e. concurrently therewith, a pair of rotatable interior raceway brushes are inserted axially from opposite ends of the cup with each of these brushes being shaped to conform to its associated interior cylindrical and conical raceway portions;

f. each of the internal raceway brushes is rotated;

g. the internal raceway brushes are removed axially and then the roller bearing cup is indexed to its next position.

Each brush is impregnated with an abrasive. Furthermore, no stops are employed but the brushes are urged pneumatically with a constant force toward its respective work surface so the brushes are self-compensating for wear.

In one form of the invention, the centrally located cylindrical raceway portion of the cup is not contacted by the surface finishing brushes. In a modified form of the invention, the internal raceway brushes are altered to surface finish this centrally located cylindrical raceway portion. In both forms of the invention, the brushes are rotated in a direction vis-a-vis the cup rotating roller to establish a force component tending to hold the rotating cup within the open pocket of the indexing means.

The inherent advantages and improvements of the present invention will become more readily apparent upon reference to the following detailed description of the invention and upon reference to the accompanying drawings in which.

Figure 1:
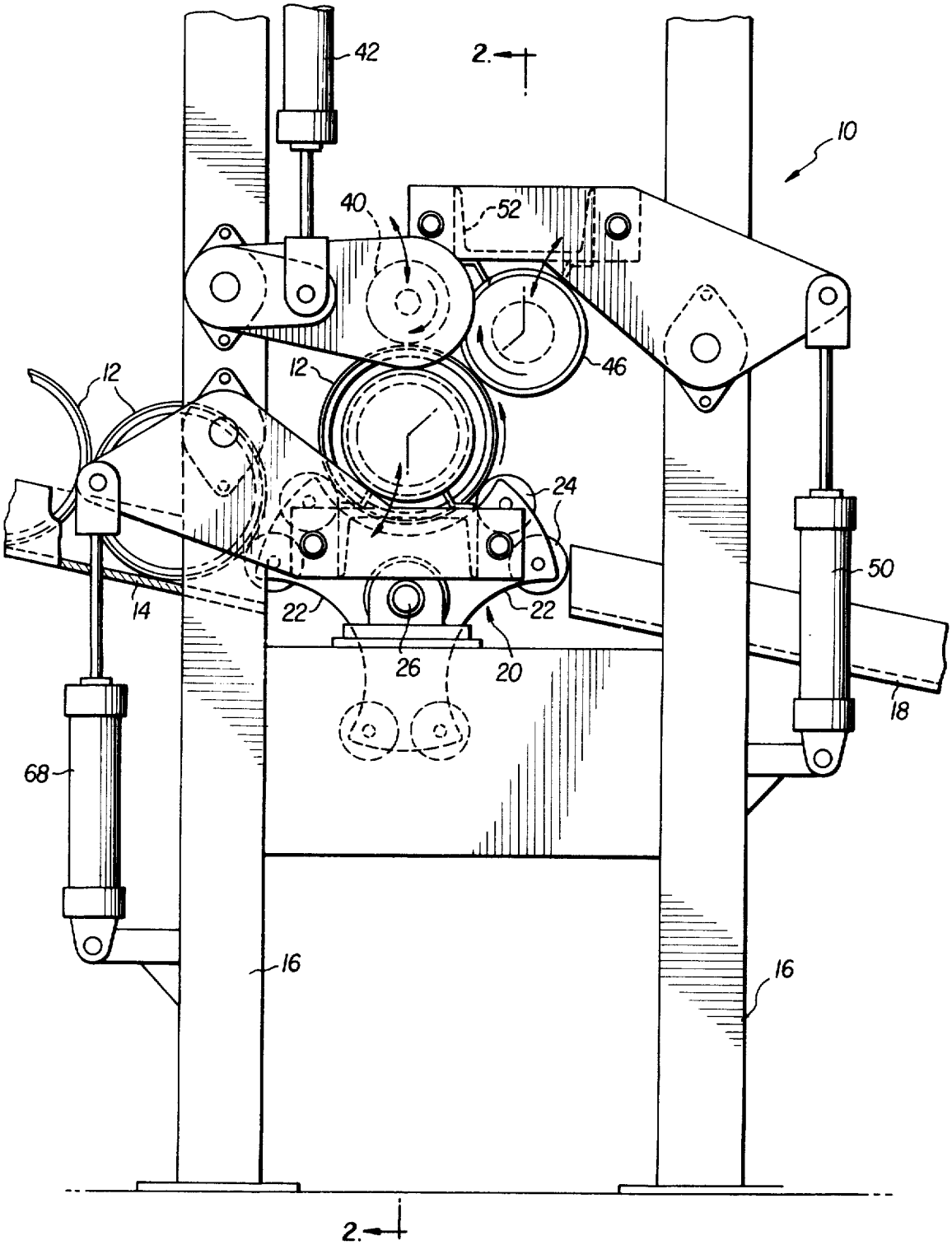
FIG. 1 is a fragmentary front elevational view, taken partially in vertical cross section, of the apparatus of the present invention.

Referring now to FIG. 1 of the drawings, there is illustrated a cup finishing machine indicated generally at 10. This cup finishing machine is adapted to receive a plurality of tapered roller bearing cups 12 from a gravity infeed chute 14 supported on one portion of a frame 16. A gravity outfeed chute 18 is also illustrated and is attached to another section of frame 16. In between the infeed and outfeed chutes is an indexing means indicated generally at 20. The indexing means has a series of three open pockets 22 in which a pair of rollers 24 cooperate with each defined pocket to support one of the cups to be surface finished. This constitutes the main work station and is located directly above the central axis 26 of the apparatus about which the indexing means is sequentially rotated in conventional manner. The rollers 24 of the indexing means 20 extend inwardly from and are supported by a pair of face plates 28 which are illustrated in FIG. 2.

Figure 2:
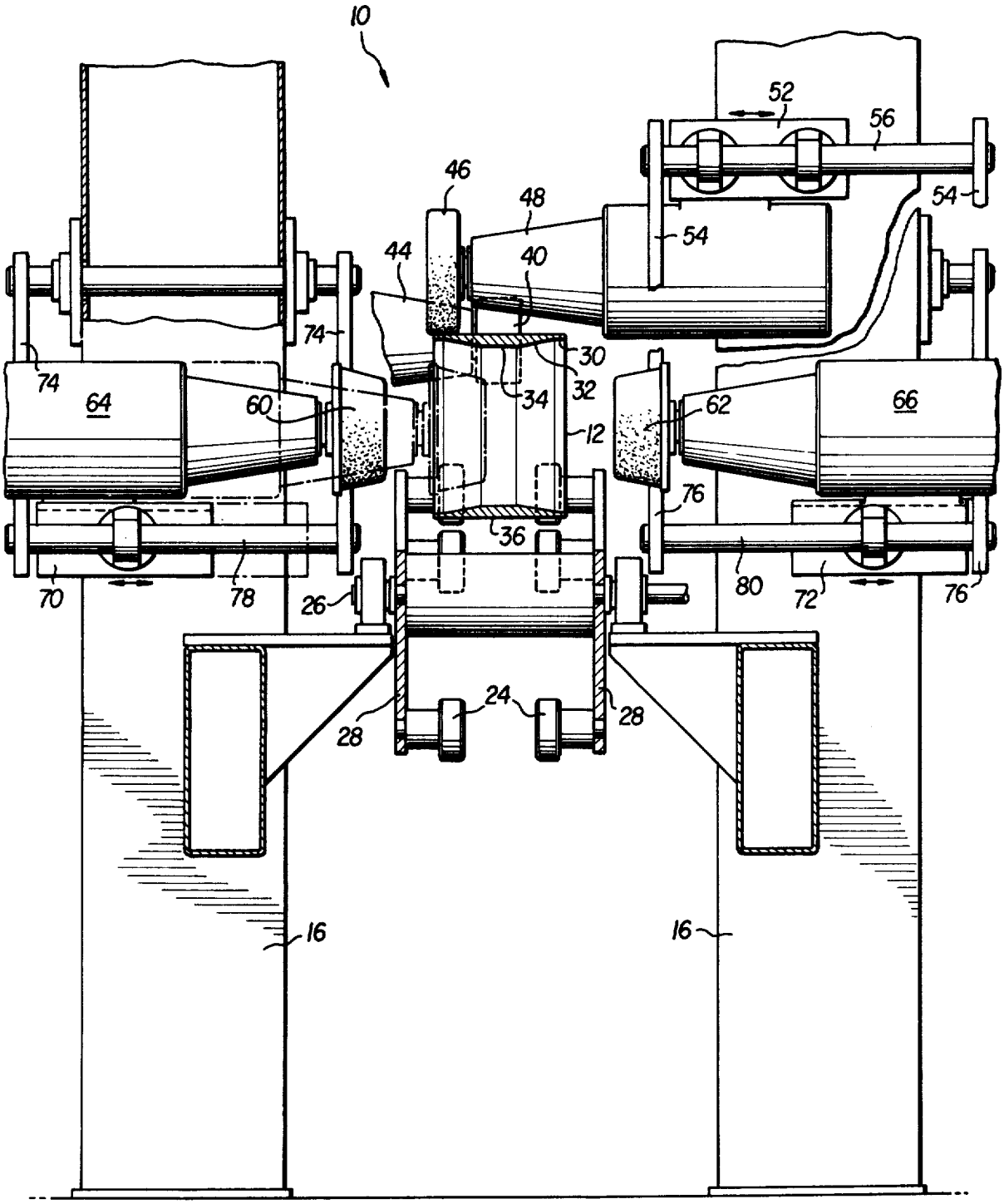
FIG. 2 is an end elevational view with parts broken away and taken in cross section along line 2—2 of FIG. 1.

As best seen in FIG. 2, each cup 12 has an internal raceway which includes a pair of opposed cylindrical seal counterbores, one of which is shown at 30, and a pair of conical raceway surfaces, one of which is shown at 32, which slope toward a centrally located cylindrical raceway portion 34. Each cup 12 also has a cylindrical outer diameter 36. All of these surfaces are surface-finished in accordance with a preferred embodiment of this invention.

Means are provided to rotate the cup 12 when it arrives at the surface finishing work station shown in FIG. 2 by means of a drive roller 40. This drive roller is pivotally mounted from the frame and pneumatically urged into engagement with cup 12 such as by means of an air cylinder 42, FIG. 1. The means for rotating the drive roller itself consists of motor 44 which is fragmentarily shown in FIG. 2 and which pivots with the drive roller 40 as part of an integral unit.

Means are provided for surface finishing the outer cylindrical diameter of cup 12. These means include an exterior brush 46 which moves with an associated motor drive 48 and pivots into contact with the cup 12 with the aid of an air cylinder 50 shown in FIG. 1. The assembly of the exterior brush 46 and its motor drive 48 is also driven and supported by a carriage 52. Thus, the assembly 46, 48 is axially driven so as to permit brush 46 to traverse the outer diameter 36 of cup 12 by means of an actuator, not shown. Such an actuator, pneumatic or hydraulic, may be mounted on the back side of pivot plate 54.

At the same time brush 46 traverses outer diameter 36 of cup 12, a pair of internal brushes 60, 62 are in operation work finishing the inboard and outboard seal counterbores 30 and the inboard and outboard conical raceways 32. In order to accomplish this, each brush 60, 62 is provided with a first surface having the same slope as the interior slope of the conical raceway surface 32 and a second cylindrical portion for engagement with the cylindrical seal counterbores 30. The mounting, positioning and rotation used for brush 46 is also applied to internal raceway brushes 60, 62. Thus, each internal raceway brush 60, 62 has an associated motor 64, 66 respectively for rotating the internal brushes. The brushes 60, 62 are themselves located on the nominal center line of the cup 12 by means of a pneumatic drive such as by air cylinder 68 shown in FIG. 1. Each of the brushes 60, 62 is mounted on a carriage 70, 72 respectively with the assembly of the brush and motor being axially driven by actuators, not shown. For example, one suitable actuator for the brushes 46, 60 and 62 is an air or hydraulic cylinder mounted on the back surface of pivot plates 74 and 76.

Figure 3:
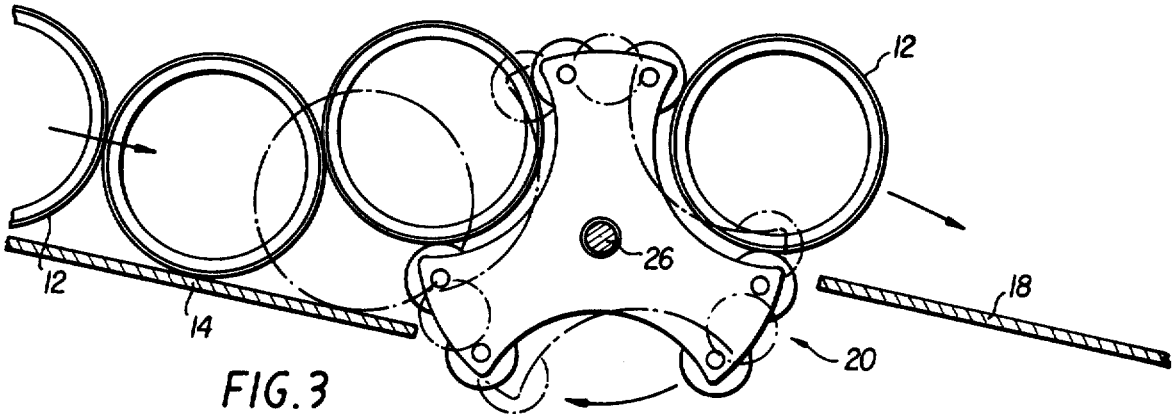
FIGS. 3 and 4 are fragmentary front elevational views showing the infeed and outfeed means together with the indexing means.
Figure 4:
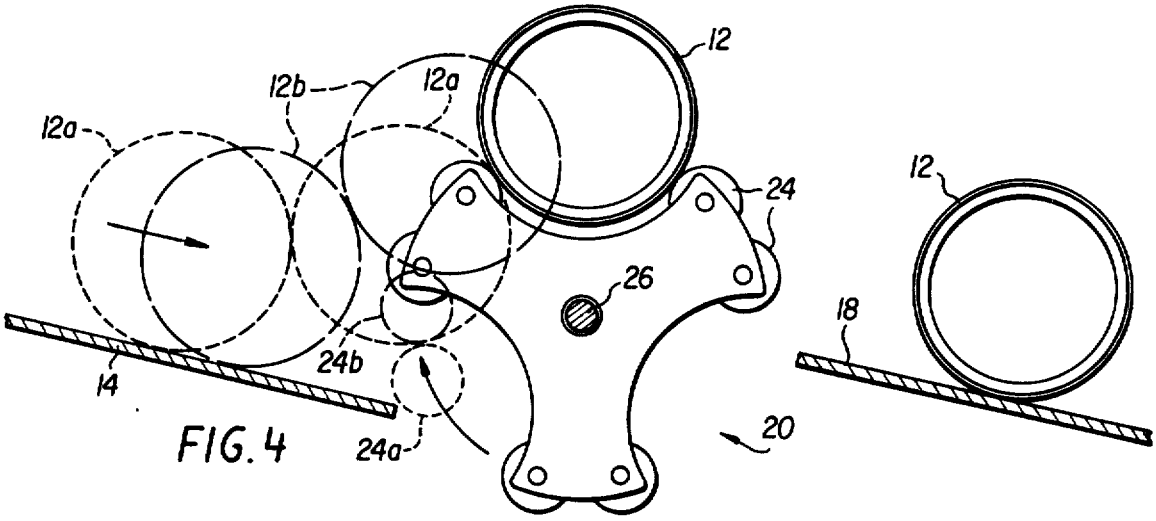

FIGS. 3 and 4 illustrate the manner in which the gravity feed chute 14 is instrumental in lifting a cup 12 from the phantom position in FIG. 3 to the full line position in FIG. 4 directly above central axis 26. Thus, a first position is illustrated in FIG. 3 as the indexing means 20 begins to rotate in a clockwise direction. Second and third progressive positions are indicated in FIG. 4 designated by the **12*a*, 12*b* positions for the cups and the corresponding 24*a*, 24*b* positions for the rollers on the indexing means 20**.

Figure 5:
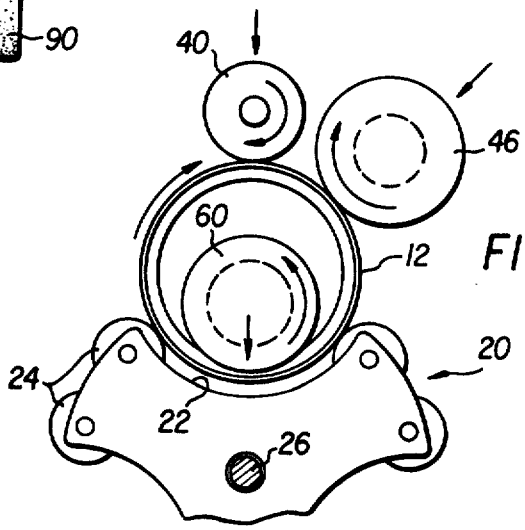
FIG. 5 is a fragmentary front elevational view, schematic in nature, showing the directions of rotations of the elements at the surface finishing station.

FIG. 5 illustrates the directions of rotation for the drive roller 40, the exterior brush 46 and the internal raceway brushes 60, 62 with the latter being behind the lead brush 60. These directions of rotation are such as to effect a force which tends to maintain the cup 12 within an open pocket 22 of the indexing means 20.

Figure 6:
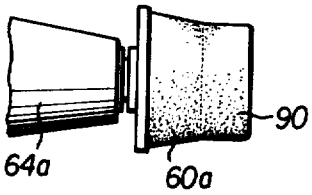
FIG. 6 is a fragmentary side elevational view of a modified brush construction.

FIG. 6 illustrates a modified form of one of the internal raceway brushes designated **60*a* which is rotated by an associated motor 64*a*. In this figure, an extension for the brush is provided at 90 so that the brush may be used to surface finish the cylindrical interior surface 34 of the raceway for cup 12**.

In operation, cups 12 are admitted to the infeed chute 14 in both random order and size. As the cups reach the indexing means 20, the presence of more than one cup on the chute 14 is instrumental in lifting a cup into an open pocket 22 of the indexing means 20 as is illustrated in FIGS. 3 and 4 until the cup reaches the work station indicated directly over the axis 26. At this time the air cylinders 42, 50 and 68 are energized to pivot drive roller 40 into engagement with cup 12 and also to pivot all surface finishing brushes toward the cup 12. For example, exterior brush 46 is pivoted into engagement with the cylindrical outer diameter of cup 12 and the pair of internal raceway brushes 60, 62 are pivoted to the nominal center line for the cup. As motor 44 drives drive roller 40 to rotate cup 12, motors 48, 64, and 66 rotate their respective brushes. Also the actuators, not shown, may be mounted on pivot plates 54, 74, and 76 to drive their respective assemblies axially of carriages 52, 70, 72, whereby brush 46 traverses the cylindrical outer diameter of the cup and internal brushes 60, 62 engage the cylindrical seal counterbores 30 and the conical raceway surfaces 32 within the cup 12 so as to surface finish these cup surfaces.

No stops are used for the brushes so that they are wear compensating and a constant force is administered pneumatically or hydraulically by their associated cylinders. The uniform operations of the combination finishing operations will highlight any surface imperfections on the cup enabling a more thorough and efficient visual inspection of these surfaces if required. The machine is completely automatic and no operator is required, nor is any set up required since random size cups may be processed. All brushes are presented at right angles or normal to the surface to be finished.

While presently preferred embodiments of this invention have been illustrated and described, it will be recognized that the invention may be otherwise variously embodied and practiced within the scope of the claims which follow.

What is claimed is:

1. A method of effecting combined surface finishing operations for roller bearing cups, each of said cups having a cylindrical outer diameter surface and an internal raceway, said internal raceway having opposed inboard and outboard cylindrical counterbores and a pair of conical inboard and outboard raceway surfaces which slope toward a centrally located cylindrical raceway portion, said method comprising the steps of a. feeding roller bearing cups to an indexing means, b. sequentially indexing said cups with said indexing means from an infeed position to an outfeed position, c. engaging said cup to be surface finished with a rotatable drive roller to rotate said cup, d. contacting said cylindrical outer diameter surface of said cup with a first brush and traversing the length of said cup while said cup is being rotated, e. simultaneously axially inserting a pair of rotatable internal raceway brushes from opposite ends of said cup with each of said internal raceway brushes having a first conical portion which has substantially the same slope as the slope of associated conical raceway surface and a second portion on each of said internal raceway brushes for engagement with its associated cylindrical counterbore raceway portion, f. rotating said internal raceway brushes, g. axially removing said internal raceway brushes before indexing said roller bearing cup.

h. and presenting all of said brushes at right angles to their respective surfaces to be finished.

2. A method of effecting combined surface finishing operations for roller bearing cups as defined in claim 1 including the additional step of impregnating said brushes with an abrasive.

3. A method of effecting combined surface finishing operations for roller bearing cups as defined in claim 1 including the additional step of pneumatically or hydraulically driving said brushes with said brushes being mounted to be self-compensating for wear.

4. A method of effecting combined surface finishing operations for roller bearing cups as defined in claim 1 including the additional step of providing a gravity feed toward said indexing means for said roller bearing cups where the next succeeding cup bears against the preceding cup which is about to be entered into the indexing means in order to facilitate entry of said cup into a pocket means of said indexing means.

5. A method of effecting combined surface finishing operations for roller bearing cups as defined in claim 1 including the additional step of pivotally mounting said outer diameter surface engaging brush so as to make it wear compensating and adaptable to different sized roller bearing cups.

6. A method of effecting combined surface finishing operations for roller bearing cups as defined in claim 1 including the additional step of providing a cylindrical brush extension on at least one of said internal raceway brushes to surface finish the centrally located cylindrical raceway portion of said roller bearing cup.

7. A method of effecting combined surface finishing operations for roller bearing cups as defined n claim 1 including the additional steps of a. providing said indexing means with open pockets, and b. rotating said rotatable drive roller, and said pair of rotatable internal raceway brushes in directions to produce a force component tending to hold the cup being surface finished within an open pocket of said indexing means.

8. An apparatus for surface finishing roller bearing cups, each of said cups having a cylindrical outer diameter surface and an internal raceway, said internal raceway having opposed inboard and outboard cylindrical counterbores and a pair of conical inboard and outboard raceway surfaces which slope toward a centrally located cylindrical raceway portion, said apparatus comprising:

a. means for feeding roller bearing cups to an indexing means, b. indexing means to receive said cups and feed them to a surface finishing station, c. a drive roller engageable with said cylindrical outer diameter of a cup at said surface finishing station to effect rotation of said cup, d. first brush means engageable with the outer diameter of said cup at said surface finishing station to effect surface finishing of the outer diameter of said cup, (1) means to rotate said first brush, e. second brush means engageable with said internal raceway of said cup at said surface finishing station, said second brush means consisting of a pair of brushes mounted for axial motion at opposite ends of the cup being surface finished, (1) means to rotate said second brush means, f. and means for receiving said cups after said cups have been surface finished.

9. An apparatus for surface finishing roller bearing cups as defined in claim 8 wherein said drive roller is pivotally mounted so as to accommodate various sized cups.

10. An apparatus for surface finishing roller bearing cups as defined in claim 8 wherein said first brush means is pivotally mounted to be brought into contact with said cup and includes means urging said first brush against said cylindrical outer diameter with a constant force to make said first brush self-compensating for wear.

11. An apparatus for surface finishing roller bearing cups as defined in claim 8 wherein said means to rotate said first brush means comprises a motor drive means mounted for movement with said first brush means and said means to rotate said second brush means comprises a motor drive means mounted for movement with said second brush means.

12. An apparatus for surface finishing roller bearing cups as defined in claim 8 including carriage means for mounting each of said motor drive means and means for advancing and retracting each of said motor drive means parallel to the longitudinal axis of the cup being surface finished.

13. An apparatus for surface finishing roller bearing cups as defined in claim 10 wherein said means to rotate said first brush means comprises a motor drive means mounted for movement with said first brush means and said means to rotate said second brush means comprises a motor drive means mounted for movement with said second brush means.

14. An apparatus for surface finishing roller bearing cups as defined in claim 13 including carriage means for mounting each of said motor drive means and means for advancing and retracting each of said motor drive means parallel to the longitudinal axis of the cup being surface finished.

* * * * *